United States Patent [19]

Stroud

[11] 4,318,207

[45] Mar. 9, 1982

[54] BELT FASTENER

[76] Inventor: Ronald Stroud, 2332 Addie Ave., St. Louis, Mo. 63114

[21] Appl. No.: 24,885

[22] Filed: Mar. 29, 1979

[51] Int. Cl.[3] ..... A44B 11/25

[52] U.S. Cl. ..... 24/163 K; 24/206 R; 24/265 BC

[58] Field of Search ..... 24/20 LS, 73 BG, 73 BH, 24/76, 77 R, 77 S, 163 R, 163 K, 163 KO, 164 R, 165, 166, 168, 206 R, 265 R, 265 BC; 2/321; 292/256.6

[56] References Cited

U.S. PATENT DOCUMENTS

| | | | |
|---|---|---|---|
| 186,569 | 1/1877 | Huerta | 24/168 |
| 639,048 | 12/1899 | Hubbard | 24/77 R |
| 1,662,074 | 3/1928 | McMeans | 2/321 X |
| 1,733,538 | 10/1929 | Herschede | 24/206 R |
| 1,900,147 | 3/1933 | Wirth | 24/163 R |
| 2,035,031 | 3/1936 | Von Koczian | 24/163 R X |
| 2,405,271 | 8/1946 | Siegel | 24/77 R |
| 2,943,332 | 7/1960 | Meeker | 2/321 |
| 3,777,315 | 12/1973 | Norfolk | 24/77 R X |
| 3,883,928 | 5/1975 | Blake | 24/163 R |

FOREIGN PATENT DOCUMENTS

| | | | |
|---|---|---|---|
| 226078 | 6/1943 | Switzerland | 24/163 R |
| 267764 | 7/1950 | Switzerland | 24/163 R |
| 289750 | 5/1928 | United Kingdom | 24/206 R |
| 1085214 | 9/1967 | United Kingdom | 24/163 R |

*Primary Examiner*—Thomas J. Holko

*Attorney, Agent, or Firm*—Cohn, Powell & Hind

[57] ABSTRACT

A belt fastener for a belt having a pierced end and a looped end. A threaded post is attached to the pierced end of the belt and a washer is hingedly attached to the looped end of the belt. The washer receives the threaded post and a threaded fastener threadedly engages the threaded post and retains the washer on the post to fasten the belt.

4 Claims, 8 Drawing Figures

BELT FASTENER

BACKGROUND OF THE INVENTION

This invention relates generally to a belt fastener and particularly to a fastener having threadedly connectible members for fastening a belt.

Threadedly connectible belt fasteners are not in themselves new. U.S. Pat. No. 3,883,928 discloses a belt buckle having a threaded tongue attached to the looped end of a belt which is received by the pierced end of the belt and held in place by a threaded cap. When the buckle is used on a conventional belt this arrangement requires that the diameter of the threaded tongue be sufficiently small to pass through the pierced end openings and that the threaded cap be attachable to the small threaded tongue. It is also necessary that the threaded tongue pass through the slot in the looped end of the belt, thereby requiring that the belt have a slot in the looped end of sufficiently large size to pass the threaded tongue. These requirements result in the disadvantages that either the tongue and fastener must be quite small or, alternatively, a special belt construction must be used. These disadvantages are overcome by the present fastener in a manner not disclosed in the known prior art.

SUMMARY OF THE INVENTION

This belt fastener can be used for a conventional belt having a pierced end and a looped end. The belt fastener includes a threaded member which is attached to the pierced end of the belt and which is fastened to the looped end of the belt.

The belt fastener includes a threaded post and means for attaching said post to the pierced end of the belt; a washer having an opening for receiving said post and means for attaching said washer to the looped end of the belt, and a threaded fastener, threadedly engaging said post and retaining the washer on said post.

In one aspect of the invention the post attachment means includes a stop disposed on the opposite side of the belt to the post, and means connected between said stop and said post.

In another aspect of the invention, the post attachment means includes a flat-headed fastener having a threaded portion extending through the pierced end of the belt and the post threadedly receives the threaded portion to clamp said post to the pierced end of the belt.

In a further aspect of the invention the post attachment means includes a clip overfitting the belt and having a projection extending into a pierced portion of the pierced end of the belt for maintaining the position of the clip on the pierced end of the belt, said post being attached to the clip.

In yet another aspect of the invention, the washer attachment means includes means received by the belt loop and means connected to said washer.

In still another aspect of the invention, the washer attachment means includes a frame having a first portion received by the looped end of the belt, and a second portion connected to the washer. An opening between said first and second portions of the frame receives the pierced end of the belt.

In another aspect, the second portion of the frame is hingedly attached to the washer.

In yet another aspect of the invention, the threaded fastener is a nut of shallow thickness, such as a jam nut, and the threaded post has a length substantially equal to the combined thickness of the jam nut and the washer.

DESCRIPTION OF THE PREFERRED EMBODIMENT

Figure 1:
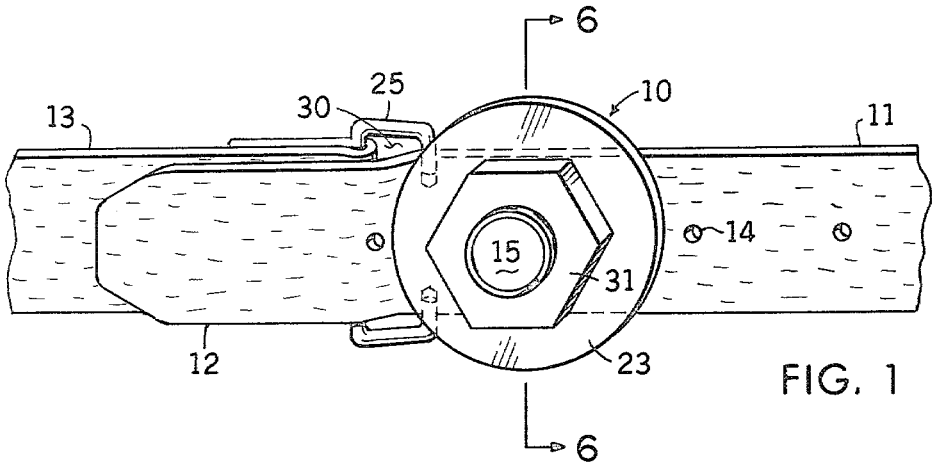
FIG. 1 is a front elevational view of the belt fastener as used on a conventional belt.

Referring now by reference numerals to the drawings and first to FIG. 1, it will be understood that the belt fastener, generally indicated by 10, is for a belt 11 having a pierced end 12 and a looped end 13. The pierced end 12 of the belt 11 includes a plurality of holes 14 constituting pierced portions of the belt and the looped end 13 is connected as by snap fasteners 28.

Figure 2:
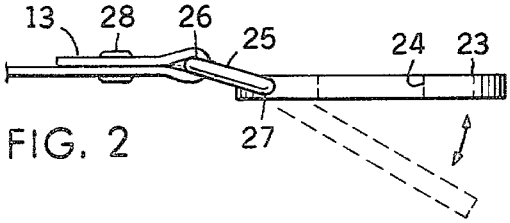
FIG. 2 is a top plan view of the washer and belt looped end.
Figure 4:
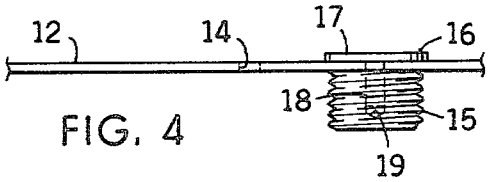
FIG. 4 is a top plan view of the threaded post and belt pierced end.
Figure 3:
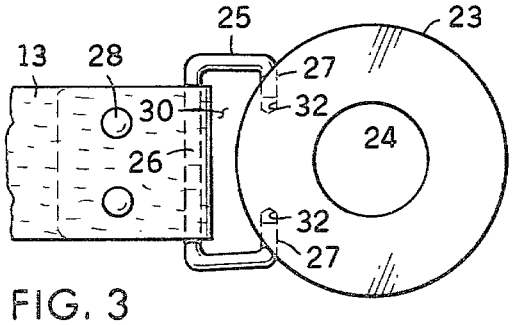
FIG. 3 is a front elevational view of the washer and belt looped end.
Figure 5:
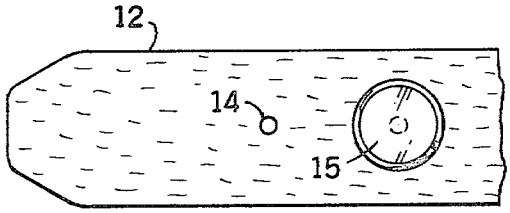
FIG. 5 is a front elevational view of the threaded post belt pierced end.

As shown in FIGS. 4 and 5 a threaded post 15 is attached to the belt pierced end 12 at an opening 14. As shown in FIGS. 2 and 3, a washer 23 is attached to the belt looped end 13 and a nut 31 completes the assembly which will now be more specifically described.

Figure 6:
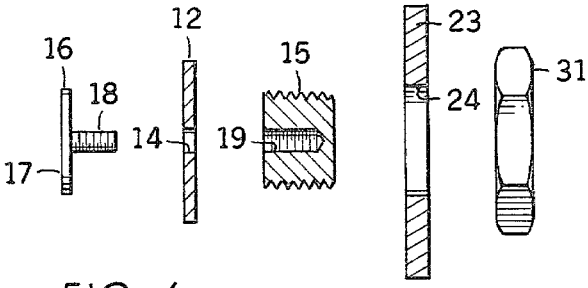
FIG. 6 is an exploded cross sectional view of the belt fastener taken on line 6—6 of FIG. 1.

In the preferred embodiment the post attachment means includes a flat-headed fastener 16, shown most clearly in FIG. 6. The flat head 17 of the fastener 16 constitutes a stop which is disposed on one side of the belt 11 when the post 15 is on the other side of the belt 11. The flat-headed fastener 16 has a threaded portion 18 which extends through a selected hole 14 of the belt pierced end 12 as shown in FIG. 4, and the threaded portion 18 of the fastener 16 is threadably received by the post 16 within a threaded socket 19, and provides the means connecting the head 17 and the post 15 to clamp the post 15 to the pierced end 12 of the belt 11.

Figure 7:
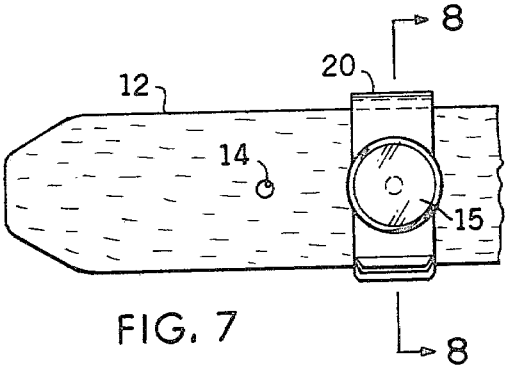
FIG. 7 is a front plan view of a modified post attachment utilizing a clip on the pierced end of the belt.
Figure 8:
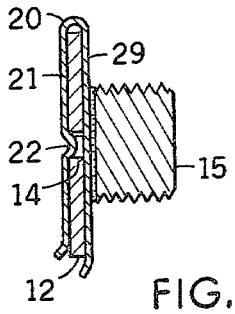
FIG. 8 is a cross sectional view of the modified post attachment taken on line 8—8 of FIG. 7.

In another embodiment a modified fastener shown in FIGS. 7 and 8, a clip 20 provides the post attachment means. As can be seen most clearly in FIG. 8, the clip 20 overfits the belt 11 and includes a back portion 21 having a projection 22 and a front portion 29. The projection 22 extends into a selected hole 14 in the belt pierced end 12 for maintaining the position of the clip 20 on the belt 11, and the threaded post 15 is rigidly connected to the clip 20 as by brazing. In this embodiment, the clip back portion 21 constitutes the stop, and the front portion 29 of the clip 20 provides the means connecting the back portion 21 and the post 15 to maintain the post 15 on the pierced end 12 of the belt 11.

The washer 23, which constitutes a plate member, has an opening 24 for receiving the threaded post 15. The washer attachment means includes a frame 25 having a first portion 26 providing means received by the looped end of the belt such that the frame 25 is hingedly attached to the looped end 13 of the belt 11. A second portion 27 of the frame 25 provides means connecting the frame to the washer 23. In the preferred embodiment the second portion 27 includes spaced ends hingedly attached to the washer 23 as by sockets 32 provided therein. An opening 30 between the first portion 26 and the second portion 27 of the frame 25 receives the pierced end 12 of the belt 11. This can be clearly seen in FIG. 1 and it will be understood that the hinged attachment of the frame 25 to the belt looped end 13 and to the washer 24, permits the washer 24 to be parallel to the belt looped end 13 as the belt looped end 13 passes through the opening 30 in the frame 25.

The nut 31, which constitutes a threaded fastener, threadedly engages the post 15 to retain the washer 23 on said post 15. In the preferred embodiment the nut 31 is a double chamfer hexagon jam nut having a thickness about fifty percent (50%) of the thickness of a regular nut. The threaded post 15 has a length substantially equal to the combined thickness of the nut 31 and the washer 23.

It is though that the structural features and functional advantages of this belt fastener 10 have become fully apparent from the foregoing description of parts, but for completeness of disclosure the use of the fastener will be briefly discussed with respect to the first embodiment.

The threaded post 15 is selectively attached at a hole 14 to the pierced end 12 of the belt 11 to suit the particular wearer. As can be seen in FIG. 4, the threaded portion 18 of the flat-headed fastener 16 is inserted through a hole 14 and is received within the threaded socket 19 of the post 15 to clamp the post 15 to the belt 11.

The relatively short length of the post 15 readily permits it to be passed through the waist loops of the slacks of the wearer and when this is done the pierced end 12 of the belt 11 is then inserted through the opening 30 of the frame 25. The washer 23 is then slipped over the post 15. Next, the nut 31 is threaded onto the post 15 to complete the fastening of the belt 11.

To unfasten the belt 11, the nut 31 is threadedly removed from the post 15. The washer 23 is slipped off the post 15 and the pierced end 12 of the belt 11 is withdrawn from the opening 30. The nut 31 can be replaced on the post 15 at that time to avoid loss.

I claim as my invention:

1. A belt fastener for a belt having a pierced end and a looped end, the fastener comprising:

(a) a threaded post, (b) means for attaching said post to the pierced end of the belt, (c) a plate member having an opening for receiving said post, (d) means for attaching the plate member to the looped end of the belt, (e) a threaded fastener threadedly engageable with said post for retaining the plate member on said post, and (f) the post attachment means including a flatheaded fastener having a threaded portion extending through the pierced end of the belt and the post threadably receiving the threaded portion to clamp said post to the pierced end of the belt.

2. A belt fastener for a belt having a pierced end and a looped end, the fastener comprising:

(a) a threaded post, (b) means for attaching said post to the pierced end of the belt, (c) a plate member having an opening for receiving said post, (d) means for attaching the plate member to the looped end of the belt, (e) a threaded fastener threadedly engageable with said post for retaining the plate member on said post, and (f) the plate member attachment means including a frame having a first portion received by the looped end of the belt, a second portion connected to the plate member, and an opening between said first and second portions receiving the pierced end of the belt.

3. A belt fastener for a belt having a pierced end and a looped end, the fastener comprising:

(a) a threaded post, (b) means for attaching said post to the pierced end of the belt, (c) a plate member having an opening for receiving said post, (d) means for attaching the plate member to the looped end of the belt, (e) a threaded fastener threadedly engageable with said post for retaining the plate member on said post, (f) the plate member attachment means including a frame having a first portion received by the looped end of the belt, a second portion connected to the plate member, and an opening between said first and second portions receiving the pierced end of the belt, and (g) the second portion of the frame being hingedly attached to the plate member.

4. A belt fastener for a belt having a pierced end and a looped end, the fastener comprising:

(a) a threaded post having a threaded socket portion, (b) a flat-headed fastener having a threaded portion extending through a selected pierced portion of the pierced end of the belt and into the threaded socket to clamp said post to the pierced end of the belt, (c) a washer having an opening receiving the post, (d) a frame having a first portion received by the belt loop and a second portion connected to the washer, and (e) a threaded nut receiving said post and retaining the washer on said post.

* * * * *